US006071197A

United States Patent [19]

Curtis

[11] Patent Number: 6,071,197

[45] Date of Patent: Jun. 6, 2000

[54] DEVICE FOR TEACHING CORRECT PUTTING

[76] Inventor: Rick Curtis, 4032 S. 3515 West, West Valley City, Utah 84119

[21] Appl. No.: 09/204,872

[22] Filed: Dec. 3, 1998

[51] Int. Cl.[7] ..... A63B 69/36

[52] U.S. Cl. ..... 473/240; 473/256; 473/267; 473/268; 473/269; 473/241; 434/252

[58] Field of Search ..... 473/240, 238, 473/256, 267, 268, 269, 241; 434/252

[56] References Cited

U.S. PATENT DOCUMENTS 3,727,920 4/1973 Scott ..... 473/240
5,071,129 12/1991 Wilson ..... 473/240

*Primary Examiner*—George J. Marlo
*Attorney, Agent, or Firm*—Thompson E. Fehr

[57] ABSTRACT

A device for teaching correct putting that can be attached to the shaft of a putter. A mirror is pivotally attached to an arm which extends behind and is parallel to the face of the putter such that the center of gravity for the mirror is between the pivot point and the face of the putter. The mirror is oriented at such an angle that a golf ball and a target cup can be viewed simultaneously by a golfer using a putter to which the device has been attached. Rotation of the mirror caused by the relative position of the pivot point and the center of gravity for the mirror will, under the influence of gravity, maintain this desired visual image in the mirror throughout the putting stroke. A straight line is placed on the reflecting surface of said mirror in such an orientation that the plane which contains the visible line and which is perpendicular to the reflecting surface of said mirror is perpendicular to the face of the putter and aligned with the desired point of impact on the face of the putter. By aligning the straight line in the middle of both the golf ball and the target cup, a golfer using the device will be assured that the face of the putter is perpendicular to the imaginary line running between the golf ball and the target cup; and maintaining such alignment throughout the stroke of the putter, a golfer using the device will be certain that the golfer's stroke is directly toward the target cup.

4 Claims, 3 Drawing Sheets

DEVICE FOR TEACHING CORRECT PUTTING

BACKGROUND OF THE INVENTION

1. Field of the Invention

This invention relates to an attachment for the shaft of a golf putter which will teach the golfer the proper alignment for the face of the putter as well as the correct path of movement for the putter when it is utilized to strike a golf ball.

2. Description of the Related Art

The popularity of golf has resulted in a number of patents for devices which are intended to teach the proper alignment for the face of a putter and the correct stroke for putting the golf ball.

U.S. Pat. No. 5,351,962 and U.S. Pat. No. 5,499,817 use fixed members which extend from the putter and which are to be aligned parallel to the desired direction of travel for the golf ball. When putting, the golfer attempts to retain the fixed member parallel to the desired direction of travel.

Similarly, the device of U.S. Pat. No. 3,033,574 includes a structure that is clipped onto the shaft of the putter. A straight edge of this structure is then aligned parallel to the front face of the putter, and a pointer is oriented at a right angle with respect to the straight edge. Again, the golfer attempts to align the pointer in the desired direction of travel for the golf ball.

And U.S. Pat. No. 5,716,286 the straight edge utilized for alignment is automatically placed in the proper orientation.

This is accomplished by having a lateral extension that runs perpendicular to the straight edge pivotally mounted at its end opposite to the straight edge. The pivot is on an extension running parallel to the face of the putter, which extension is connected at a right angle to a third extension, which third extension is attached to the shaft of the putter. A tensioned string is attached at one end to the straight edge and at the other end to a target that is at an elevation above the intended path for the golf ball.

The tension forces the straight edge to move until it is aligned perpendicularly to the path toward the target. By aligning the face of the putter parallel to the straight edge and maintaining the tensioned string over the center of the golf ball, the golfer will have the face of the putter perpendicular to the desired direction of travel for the golf ball and will have the putter moving toward the target.

Each of the preceding patents, however, has only two points which are utilized for alignment. And the last of these patents requires the use of a remote target as well as a string connecting the alignment device with the remote target.

SUMMARY OF THE INVENTION

The present invention increases the probability of achieving the proper alignment for the face of the putter as well as the correct path of movement for the putter when it is utilized to strike a golf ball by utilizing three, rather than just two, points for alignment.

DESCRIPTION OF THE PREFERRED EMBODIMENT

Figure 1:
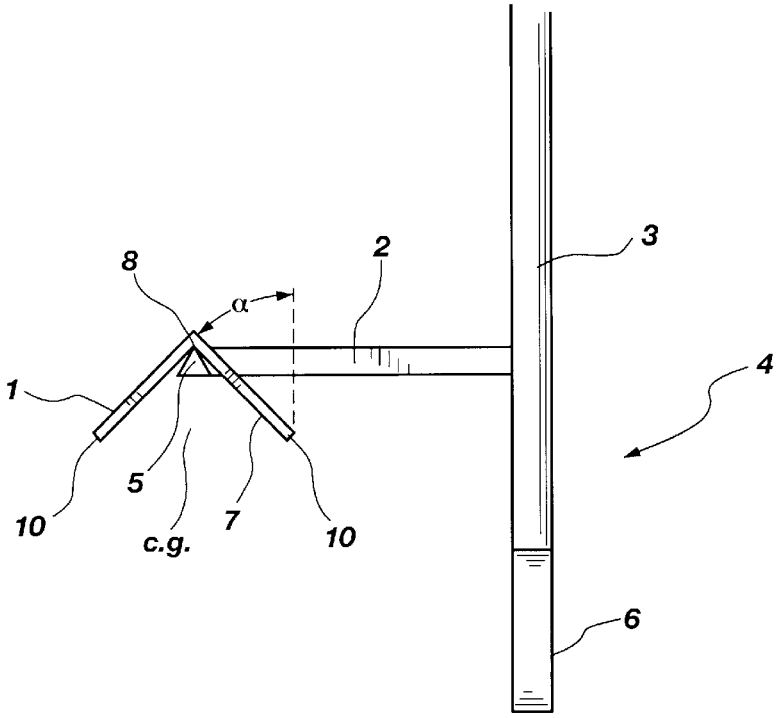
FIG. 1 is a side view of the Device for Teaching Correct Putting installed on the shaft of a putter.
Figure 2:
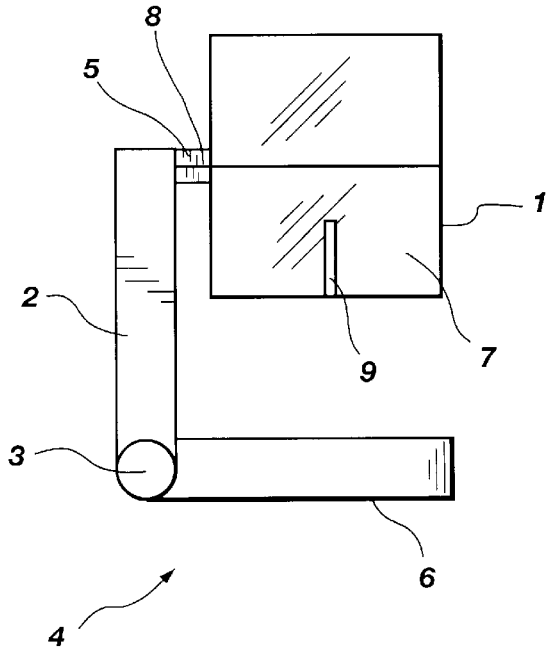
FIG. 2 is an overhead view of the Device for Teaching Correct Putting installed on the shaft of a putter.
Figure 5:
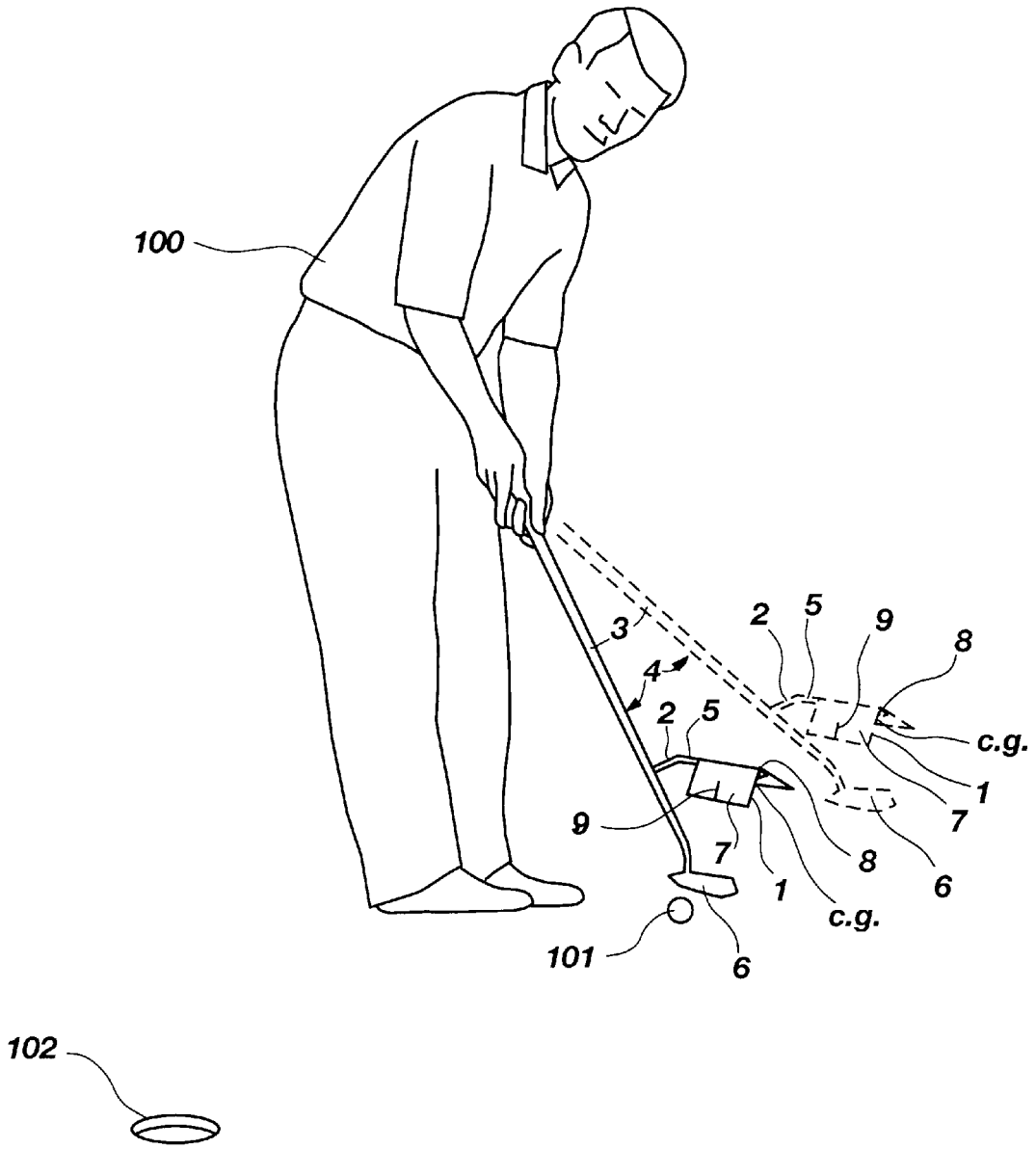
FIG. 5 depicts a golfer using the Device for Teaching Correct Putting attached to a putter and being used by a golfer, illustrating the orientation of the mirror during different phases of a stroke.

As portrayed in FIG. 1 and FIG. 2, a mirror 1 is pivotally attached to an arm 2 which is connected to the shaft 3 of a putter 4. The rearward portion 5 of the arm 2, which supports the mirror 1 and about which the mirror 1 pivots, is substantially, and preferably precisely, parallel to and behind the face 6 of the putter 4. The reflective surface 7 is at least substantially planar and, preferably, planar. The plane containing the substantially planar reflective surface 7 of the mirror 1 makes, as shown in FIG. 2, such an angle $\alpha$, preferably an angle of approximately 45°, with the shaft 3 of the putter 4 when such shaft 3 is vertical that the golf ball and the target cup can simultaneously be viewed in the reflecting surface 7 of the mirror 1 by a golfer who is using the putter 4. The center of gravity e.g. for the mirror 1 is between the pivot point 8 and the face 6 of the putter 4 so that as the putter 4 is moved through the putting stroke, which is illustrated in FIG. 5, the mirror 1, under the influence of gravity, will pivot about pivot point 8 to keep the golf ball 101 and the target cup 102 simultaneously viewable by the golfer 100.

A visible line 9, illustrated in FIG. 2, which is at least substantially straight and is preferably straight, is placed on the reflecting surface 7 of the mirror 1 in such an orientation that the plane which contains the line 9 and which is substantially perpendicular, and preferably perpendicular, to the reflecting surface 7 will be substantially perpendicular, and preferably perpendicular, to the face 6 of the putter 4 and that the line 9 will be at least substantially aligned, and preferably aligned, with the desired point of impact on the face of the putter 4.

Therefore, by viewing the target cup and the golf ball so that both the target cup and the golf ball are centered about the substantially straight line 9, the golfer will be assured that the face 6 of the putter 4 is perpendicular to the imaginary line running between the golf ball and the target cup; and by maintaining this relationship among the straight line 9, the golf ball, and the target cup throughout the stroke of the putter 4, the golfer will be certain that the golfer's stroke is directly toward the target cup.

Most importantly, accuracy, as compared to the prior art, is enhanced because three, rather than just two, objects are being aligned, thereby decreasing the possibility of error.

Figure 3:
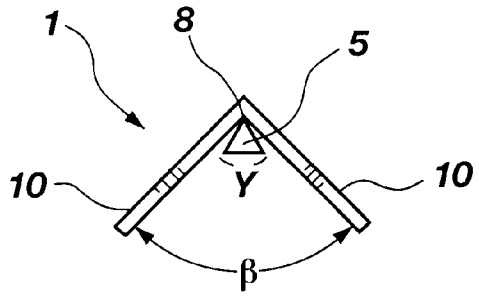
FIG. 3 illustrates the relationship between the mirror and the rearward portion of the arm which supports the mirror.
Figure 4:
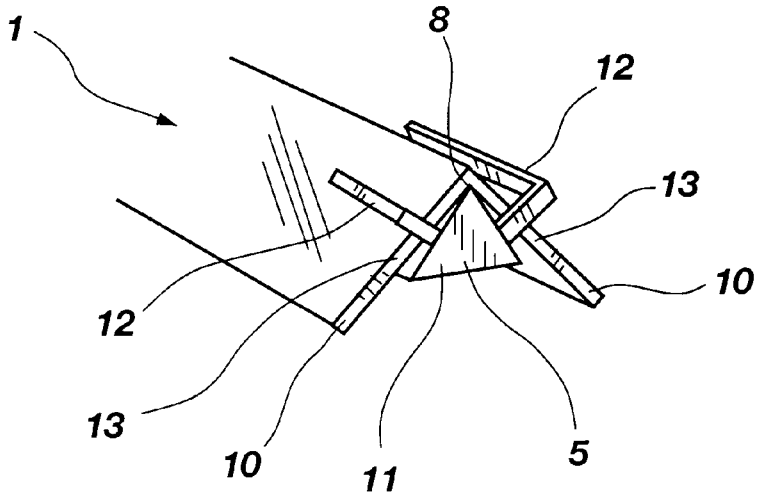
FIG. 4 portrays the preferred means for pivotally attaching the mirror to the rearward portion of the arm which supports the mirror.

The preferred means for pivotally attaching the mirror 1 to the rearward portion 5 of the arm 2, is to have the cross section of the rearward portion 5 triangular and to have the mirror 1 with a V-shaped cross section. As depicted in FIG. 3, the angle $\beta$ between the legs 10 of the mirror 1 is approximately, and preferably precisely, 90°; and the angle $\gamma$ at the apex 8 of the triangular cross section of the rearward portion 5 of the arm 2 is enough less than the angle $\beta$ that the mirror 1 can pivot on the rearward portion 5 but not so much less that mirror would rotate so much that the golfer would be unable simultaneously to view both a golf ball and a target cup.

And with the preferred means for pivotally attaching the mirror 1, it is preferred to have attached to the distal end 11 of the rearward portion 5, one or more, but preferably two, prongs 12, which folds around the distal edge 13 of the mirror 1 but which are spaced an adequate distance from the legs 9 of the mirror 1 that the mirror 1 can be removed and replaced but not such a great distance that the mirror 1 can inadvertently slip from the rearward portion 5.

I claim:

1. A device for teaching correct putting, which comprises:

an arm for attachment to the shaft of a putter, said arm having a rearward portion that is constructed such that when said arm has been attached to the shaft of the putter, the rearward portion of said arm is substantially parallel to and behind the face of the putter;

a mirror containing a substantially planar reflecting surface, said mirror being pivotally attached to the rearward portion of said arm at such an angle that when the shaft of a putter to which said arm has been attached is held vertically by a golfer, a golf ball and a target cup can simultaneously be viewed in the reflecting surface of the mirror by the golfer and said mirror having its center of gravity located between the pivot point for said mirror and the face of the putter when the device is attached to the shaft of a putter so that, as the putter to which said arm has been attached is moved through a putting stroke, said mirror will pivot about the pivot point to keep the golf ball and the target cup simultaneously viewable by the golfer; and a visible line, said visible line being substantially straight, placed on the reflecting surface of said mirror in such an orientation that the plane which contains the visible line and which is substantially perpendicular to the reflecting surface of said mirror is substantially perpendicular to the face of a putter to which said arm has been attached and substantially aligned with the desired point of impact on the face of the putter.

2. The device for teaching correct putting as recited in claim 1, further comprising:

one or more prongs attached to the distal end of the rearward portion of said arm, said prong or prongs beings spaced an adequate distance from the mirror that the mirror can be removed and replaced but not such a great distance that the mirror can inadvertently slip from the rearward portion.

3. A device for teaching correct putting, which comprises:

an arm for attachment to the shaft of a putter, said arm having a rearward portion that is constructed such that when said arm has been attached to the shaft of the putter, the rearward portion of said arm is parallel to and behind the face of the putter;

a mirror containing a planar reflecting surface, said mirror being pivotally attached to the rearward portion of said arm at such an angle that when the shaft of a putter to which said arm has been attached is held vertically by a golfer, a golf ball and a target cup can simultaneously be viewed in the reflecting surface of the mirror by the golfer and said mirror having its center of gravity located between the pivot point for said mirror and the face of the putter when the device is attached to the shaft of a putter so that, as the putter to which said arm has been attached is moved through a putting stroke, said mirror will pivot about the pivot point to keep the golf ball and the target cup simultaneously viewable by the golfer; and a straight visible line placed on the reflecting surface of said mirror in such an orientation that the plane which contains the visible line and which is perpendicular to the reflecting surface of said mirror is perpendicular to the face of a putter to which said arm has been attached and aligned with the desired point of impact on the face of the putter.

4. The device for teaching correct putting as recited in claim 3, further comprising:

one or more prongs attached to the distal end of the rearward portion of said arm, said prong or prongs beings spaced an adequate distance from the mirror that the mirror can be removed and replaced but not such a great distance that the mirror can inadvertently slip from the rearward portion.

* * * * *